US005300248A

United States Patent [19]

Pässler et al.

[11] Patent Number: 5,300,248

[45] Date of Patent: Apr. 5, 1994

[54] RUBBER COATINGS FOR CLEANING CLOTHS INCLUDING CELLULOSE MICROFIBERS

[75] Inventors: Michael Pässler, Neusäss; Hans Riepold, Aindling, both of Fed. Rep. of Germany

[73] Assignee: Firma Carl Freudenberg, Weinheim, Fed. Rep. of Germany

[21] Appl. No.: 21,819

[22] Filed: Feb. 24, 1993

[30] Foreign Application Priority Data

Feb. 24, 1992 [DE] Fed. Rep. of Germany ..... 4205547

[51] Int. Cl.[5] ..... D04H 1/58

[52] U.S. Cl. ..... 252/90; 428/250; 428/262; 428/263; 428/265; 428/903; 15/208

[58] Field of Search ..... 428/250, 262, 263, 265, 428/903; 252/90

[56] References Cited

U.S. PATENT DOCUMENTS

| | | | |
|---|---|---|---|
| 1,706,294 | 3/1929 | Jacobson | 428/263 |
| 2,459,874 | 1/1949 | Fay | 428/263 |
| 4,328,279 | 8/1982 | Meitner et al. | 428/289 |
| 4,352,846 | 10/1982 | Passler et al. | 428/105 |
| 4,468,428 | 8/1984 | Early et al. | 428/221 |
| 4,525,411 | 6/1985 | Schmidt | 428/198 |
| 4,567,093 | 1/1986 | Sogabe et al. | 428/250 |
| 4,678,698 | 7/1987 | Mencke | 428/171 |
| 5,198,292 | 3/1993 | Lerner | 428/290 |
| 5,206,087 | 4/1993 | Tokiwa et al. | 428/403 |

FOREIGN PATENT DOCUMENTS

| | | |
|---|---|---|
| 2926882 | 1/1981 | Fed. Rep. of Germany . |
| 925406 | 5/1963 | United Kingdom . |

*Primary Examiner*—Christine Skane
*Assistant Examiner*—Michael P. Tierney
*Attorney, Agent, or Firm*—Kenyon & Kenyon

[57] ABSTRACT

The subject invention is directed to rubber coatings for cleaning cloths comprised of foamed rubber and cellulose microfibers that promote biodegradability and enhance water absorbtivity and other desirable properties.

17 Claims, No Drawings

RUBBER COATINGS FOR CLEANING CLOTHS INCLUDING CELLULOSE MICROFIBERS

FIELD OF INVENTION

This invention relates to improved elastomer coatings for fabrics and more particularly rubber coated bonded fiber cloths which are non-abrasive, porous and highly absorbent.

BACKGROUND OF THE INVENTION

A multi-stage process for making rubber coated cleaning cloths is described in German Patent DE-B 1 560 783, the text of which is incorporated herein by reference. That process involves multiple impregnations of a randomly laid nonwoven fabric (non-oriented web), preferably of hydrophilic natural fibers, with a foamy aqueous binder dispersion of vulcanizable rubber; drying the impregnated cloth; coating the surfaces of the dried cloth with a coagulable foamed rubber dispersion (rubber outer coating); drying and vulcanizing the coated fabric; washing a pore-forming material contained in the coating out; and drying the washed fabric.

Conventional rubber outer coatings for such cleaning cloths are not very biodegradable or suitable for composting. Moreover, the surfaces of such cleaning cloths tend to be very sticky and demonstrate a perceptibly high wiping resistance. This quality, which is typical of rubber, can be mitigated by sprinkling talcum powder on the surfaces. However, after a cleaning cloth has been washed out, typically after the first use, the talcum powder usually almost entirely removed and the stickiness returns. Such stickiness can be so extreme that cloths that have been folded together when wet may bond themselves together so strongly after drying that the coating will be damaged when such bonded surfaces are forcibly separated.

The water absorption capacity of such cloths is largely determined by the number and size of pores present in the cured outer coating and by the fibers comprising the cloth material situated between the coatings that extend into the pores. These factors also influence such a cloth's printability and receptivity to printing colors.

OBJECTS AND SUMMARY OF THE INVENTION

An object of this invention is to provide foamed-rubber-coated-cleaning cloths having surfaces that are non-abrasive, porous and highly absorbent. Another object is to provide foamed-rubber-coated cleaning cloths that are more pleasant to handle, less apt to stick together when dried and to improve their gliding property [non-clinging effect] and absorbtivity. Another object is to provide foamed-rubber-coated cleaning cloths that are easier to print during manufacturing. Another other object is to provide cleaning cloths that have a high rubber content and nevertheless are biodegradable and capable of being composted.

It has been found that incorporating cellulose microfibers in rubber outer coatings for foamed-rubber-coated cloths reduces tackiness and improves absorbancy and biodegradability. Preferably, the microfibers are present in quantities of 20 to 100%, more preferably 20 to 50%, by weight with respect to the solid rubber weight of the coating.

The invention embraces rubber coatings including cellulose microfibers, use of such coatings and, cloth coated therewith.

DETAILED DESCRIPTION OF THE INVENTION

The term "cellulose microfibers" as used herein means mechanically comminuted cellulose having staple lengths of about 15 to 200 μm, preferably to about 60 μm. These fibers are preferably comprised of natural cellulose and are commercially available. Increasing the quantity of cellulose microfibers, sometimes referred to in technical literature as "cellulose powder" or "powdered cellulose" facilitates biodegradability. However, increasing the cellulose content in a rubber coating beyond the limits of this invention will destroy good cleaning cloth properties, particularly strength, drying quality, and cloth-like feel.

The term "rubber" as used in this application includes all natural and synthetic elastomers and mixtures, which include or are manufactured from natural rubber, synthetic NBR (Nitrile Rubber, Acrylonitrile-Butadiene elastomers) or SBR (Styrene-Butadiene elastomers) latices, as well as from mixed polymers of butadiene or isoprene. These rubbers may be self-cross-linking or vulcanizable according to conventional processes.

Bactericidal additives are not required in the coatings of this invention and should be avoided to preserve good biodegradability, i.e., compostability of the cloth and the decaying property of cellulose. In the absence of bactericidal additives cellulose fibers dispersed in a rubber coating apparently function as "islands" of natural material, which represent a nutrient medium and a space for bacteria to invade, and from where an intensified, destructive attack on surrounding rubber may follow.

The cellulose microfibers substantially reduce the stickiness of cleaning cloths coated in accordance with the invention. Thus, depending on the fiber content, one can reduce or eliminate the customary powdering of rubber coated surfaces with talcum powder needed to achieve acceptable sliding characteristics.

Wet bonding tests show that use of cellulose fibers in accordance with the invention substantially reduces the force required to separate such cloths that are folded when moist and then bonded during drying, compared to the force needed to separate similar cloths that do not include cellulose microfibers.

The slide resistance (in a moist state) of cloths according to the invention may be reduced by more that 50%. This improved gliding (non-clinging) effect produces less resistance to wiping, especially when a cloth is moist; thus a noticeably smaller expenditure of force is necessary to effectively wipe an object.

In conjunction with the open pores of the rubber coating, the roll-up effect of the cellulose microfibers promotes the water absorption capacity and the routing of the water to the inside of the cloth. This property also results in very good printability of cleaning cloths treated according to the invention, since dye can penetrate more quickly and deeper into the surface coating. Moreover, it may not be necessary to apply talcum powder which is known to impede the dye penetration capacity.

Similarly, color fastness is significantly improved, particularly in comparison to coatings treated with talcum, in which the printing color may be partially trapped on the talcum powder instead of on the actual cloth.

Coatings with cellulose fiber contents of 20 to 50% by weight, in relation to the solid rubber weight of the coating, exhibit optimal coating application properties as well as the above mentioned advantages. Fiber contents in the over 50 to 100% by weight range included in the invention are conceivable for cases in which the biodegrading or composting capability is a primary concern.

Suitable cloth or substrate can be manufactured according to known methods for bonding fibers to one another, in particular, by means of needle punching and/or by introducing thermoplastic fibers into a fiber mixture and then heat-activating them. The known bonding technique using plastic dispersions or rubber latices is also possible.

The invention will now be described in greater detail on the basis of the following examples

EXAMPLE 1

A base material is first prepared as follows A randomly laid nonwoven fabric consisting of 30% by weight of cotton, 50% by weight of rayon staple fiber, and 20% by weight of polyester fibers is mechanically pre-bonded in a needle loom, impregnated with an impregnating mixture and subsequently dried; The impregnating mixture contains rubber latex, polymerized from butadiene and acrylonitrile, vulcanizing [curing] auxiliary agents, surfactants and stabilizers, as well as cooking salt as a pore-forming material. The cooking salt content corresponds to the solids content of the rubber.

This base material, which has been mechanically and chemically prebonded as described above, is subsequently coated on both sides with a heat-sensitive and foamed rubber dispersion, which contains a mixed polymer of butadiene, acrylonitrile and methyl-acrylic acid, non-bactericidal vulcanizing auxiliary agents, surfactants and stabilizers, as well as 30% by weight in relation to the rubber solids weight of the coating, cellulose microfibers having a staple length of about 30 μm. These fibers can be obtained commercially, for example under the tradename Arbocell BE 600/30, from the firm J. Rettenmaier & Sohne GmbH & Co., in Ellwangen-Holzmuhle, Germany.

The coated base material is dried and vulcanized and the water-soluble components are washed out with water and the washed product undergoes its final drying.

For 100 parts by weight of the above-mentioned nonwoven fabric the cloth material contains 170 parts by weight of rubber vulcanizate, of which 60 parts by weight each is applied on each side of said cloth material as the coating mixture having a cellulose microfiber content of about 30% by weight with respect to its solid rubber content.

After being cut to suitable sizes, the cloth material is suitable for cleaning windows, furniture, sanitation facilities, motor vehicles and other surfaces.

Compared to cloths which have been manufactured in the same way, however without the addition of cellulose microfibers, the cleaning cloth manufactured in this manner is distinguished by advantageous properties:

To test wet bonding a moist cloth is arranged in overlapping folds and then dried. The force required to separate the folds is expressed as in N/50 mm strip width:

| | Without cellulose | With cellulose |
|---|---|---|
| Window-cleaning cloth (240 g/m$^2$) | | |
| with talcum powder | 4.3 | 1.0 |
| without talcum powder | | 0.9 |
| Automobile-cleaning cloth (280 g/m$^2$) | 5.8 | 2.0 |

The wiping force, expressed in N/500 cm$^2$, likewise drops when cellulose microfibers are included in the rubber coating.

| | Without cellulose | With cellulose |
|---|---|---|
| Window-cleaning cloth (240 g/m$^2$) | 18 | 8 |
| Automobile-cleaning cloth (280 g/m$^2$) | 22 | 10 |

Specimens of wiping cloths according to Example 1 were buried in wet earth. After four weeks, they showed clear manifestations of decomposition while a cloth not treated with cellulose microfibers, but otherwise of an analogous composition, did not show any traces of decay.

EXAMPLE 2

A randomly laid nonwoven fabric consisting of 80% by weight of rayon staple fiber and 20% by weight of polypropylene is mechanically prebonded in a needle loom and heated in a heating apparatus to such high temperatures, that the polypropylene fibers bond the adjoining rayon staple fibers as the result of plasticization or melting, and a pre-bonded base material is, thus formed. The heating apparatus can be a heat tunnel and/or a calendar with heatable rolls.

This base material, which has been pre-bonded in this manner, is subsequently coated on both sides with a heat-sensitive and foamed rubber dispersion, as in Example 1.

The advantage of this embodiment of the invention is that not only the rubber coating, but also the base material is completely free of chemicals having a bactericidal effect.

EXAMPLE 3

A base material, manufactured as in Example 2, is coated on only one side with a heat-sensitive and foamed rubber dispersion, as in Example 1.

Dispensing with a second coated side has the additional advantage of further improving the weight ratio between the cellulose—serving as a nutrient medium for bacteria and the rubber, so that the composition of the system further promotes its vulnerability to microorganism attack and thus its decaying property and composting capability.

We claim:

1. A cleaning cloth comprising a base material coated with (a) rubber, wherein the rubber is selected from the group consisting of natural rubber, styrenebutadiene rubber, nitrile-butadiene rubber, mixed polymers of butadiene and isoprene and mixtures thereof; and (b) 20 to 100% by weight cellulose microfibers based on the solid rubber content in the coating wherein the cellulose microfibers have a staple fiber length of about 15 to 200 micrometers.

2. The cleaning cloth of claim 1 wherein the cellulose microfibers comprise 20 to 50% by weight based on the solid rubber content in the coating.

3. The cleaning cloth of claim 2 wherein the cellulose microfibers have a staple fiber length in the range of about 15 to 60 micrometers.

4. The cleaning cloth of claim 2 wherein the cellulose microfibers have a staple fiber length of about 30 micrometers.

5. The cleaning cloth of claim 4 wherein the rubber is a dispersion of butadiene, acrylonitrile and methyl-acrylic acid.

6. The cleaning cloth of claim 5, wherein the cellulose microfibers are comminuted natural cellulose fibers.

7. The cleaning cloth comprising a base material coated with the composition of claim 2.

8. The cleaning cloth comprising a base material coated with the composition of claim 3.

9. The cleaning cloth comprising a base material coated with the composition of claim 6.

10. The cleaning cloth of claim 8 wherein the base material is a nonwoven fabric comprising about 30% by weight cotton, about 50% by weight rayon staple fiber and about 20% by weight polyester fiber.

11. The cleaning cloth of claim 9 wherein the base material is a nonwoven fabric comprising about 30% by weight cotton, about 50% by weight rayon staple fiber and about 20% by weight polyester fiber.

12. The cleaning cloth of claim 8 wherein the base material is a nonwoven fabric comprising about 80% by weight rayon staple fiber and about 20% by weight polypropylene.

13. The cleaning cloth of claim 9 wherein the base material is a nonwoven fabric comprising about 80% by weight rayon staple fiber and about 20% by weight polypropylene.

14. The cleaning cloth of claim 10 wherein the base material is impregnated with a mixture of rubber latex polymerized from butadiene and acrylonitrile, a vulcanizing agent, a surfactant, a stabilizer and cooking salt.

15. The cleaning cloth of claim 11 wherein the base material is impregnated with a mixture of rubber latex polymerized from butadiene and acrylonitrile, a vulcanizing agent, a surfactant, a stabilizer and cooking salt.

16. The cleaning cloth of claim 12 wherein only a portion of the base material is coated.

17. The cleaning cloth of claim 13 wherein only a portion of the base material is coated.

* * * * *